US010629118B2

(12) United States Patent
Choi et al.

(10) Patent No.: US 10,629,118 B2
(45) Date of Patent: Apr. 21, 2020

(54) ORGANIC LIGHT EMITTING DISPLAY DEVICE AND METHOD FOR DRIVING THE SAME

(71) Applicant: LG DISPLAY CO., LTD., Seoul (KR)

(72) Inventors: Namseok Choi, Gimpo-si (KR); Jintaek Choi, Goyang-si (KR); Jeisung Lee, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 184 days.

(21) Appl. No.: 15/814,040

(22) Filed: Nov. 15, 2017

(65) Prior Publication Data

US 2018/0151117 A1 May 31, 2018

(30) Foreign Application Priority Data

Nov. 28, 2016 (KR) ..... 10-2016-0159278

(51) Int. Cl.
*G09G 3/3208* (2016.01)
*G09G 3/3225* (2016.01)

(52) U.S. Cl.
CPC ... *G09G 3/3225* (2013.01); *G09G 2320/0285* (2013.01); *G09G 2320/041* (2013.01); *G09G 2320/043* (2013.01); *G09G 2320/0666* (2013.01); *G09G 2330/10* (2013.01); *G09G 2330/12* (2013.01); *G09G 2360/16* (2013.01)

(58) Field of Classification Search
CPC ..... G09G 3/3225; G09G 2360/16; G09G 2330/12; G09G 2330/10; G09G 2320/0285; G09G 2320/041; G09G 2320/0666; G09G 2320/043
See application file for complete search history.

(56) References Cited

U.S. PATENT DOCUMENTS 8,791,884 B2 * 7/2014 Kim ..... G09G 3/3225 315/169.3
2002/0105279 A1 * 8/2002 Kimura ..... G09G 3/3233 315/169.3

(Continued)

FOREIGN PATENT DOCUMENTS

EP 2081175 A2 7/2009
JP 2002-23702 A 1/2002

(Continued)

*Primary Examiner* — Ibrahim A Khan
(74) *Attorney, Agent, or Firm* — Birch, Stewart, Kolasch & Birch, LLP

(57) ABSTRACT

An organic light emitting display device includes a display panel and a deterioration compensation unit. The display panel comprises a plurality of unit pixels each comprising at least three sub-pixels corresponding to different colors and an organic light emitting diode. The deterioration compensation unit generates deterioration estimation data of each of the sub-pixels based on cumulative data of each of the sub-pixels, generates first and second temperature deterioration data based on display temperature data corresponding to temperature of the organic light emitting display device, calculates an individual compensation gain corresponding to each of the sub-pixels based on the deterioration estimation data and the first and second temperature deterioration data, and corrects input data of each of the sub-pixels based on the individual compensation gain of each of the sub-pixels.

12 Claims, 9 Drawing Sheets

(56) References Cited

U.S. PATENT DOCUMENTS

| | | | | |
|---|---|---|---|---|
| 2004/0150594 | A1 | 8/2004 | Koyama et al. | |
| 2008/0088545 | A1* | 4/2008 | Chen | G09G 3/3225 345/76 |
| 2008/0231558 | A1* | 9/2008 | Naugler | G09G 3/3233 345/76 |
| 2011/0032275 | A1* | 2/2011 | Marcu | G09G 3/2003 345/690 |
| 2013/0321361 | A1* | 12/2013 | Lynch | G09G 3/3225 345/204 |
| 2014/0118426 | A1 | 5/2014 | Chun et al. | |
| 2014/0176403 | A1* | 6/2014 | Inoue | G09G 3/3208 345/77 |
| 2015/0054542 | A1* | 2/2015 | Song | G09G 3/006 324/762.01 |
| 2016/0293102 | A1* | 10/2016 | Chaji | G09G 3/20 |
| 2016/0307498 | A1* | 10/2016 | Chaji | G09G 3/3291 |
| 2017/0076659 | A1* | 3/2017 | Zhang | G09G 3/3208 |
| 2017/0124943 | A1* | 5/2017 | Peana | G09G 3/3225 |
| 2018/0075798 | A1* | 3/2018 | Nho | G09G 3/32 |
| 2018/0082634 | A1* | 3/2018 | Wang | G09G 3/3233 |

FOREIGN PATENT DOCUMENTS

| | | | |
|---|---|---|---|
| JP | 2011-82213 | A | 4/2011 |
| JP | 2012-73400 | A | 4/2012 |

* cited by examiner

ORGANIC LIGHT EMITTING DISPLAY DEVICE AND METHOD FOR DRIVING THE SAME

CROSS-REFERENCE TO RELATED APPLICATION

This application claims the priority benefit of Korean Patent Application No. 10-2016-0159278, filed on Nov. 28, 2016 in the Korean Intellectual Property Office, the disclosure of which is incorporated herein by reference into the present application.

BACKGROUND

1. Technical Field

The present invention relates to an organic light emitting display device and a method for driving the same, and, more particularly, to an organic light emitting display device which can compensate for difference in degree of deterioration between pixels, and a method for driving the same.

2. Description of the Related Art

Flat displays are applied to various electronic devices such as TVs, mobile phones, laptops, and tablets. For this purpose, research has been conducted to develop a thinner, lighter, and lower power consumption display.

Typical examples of flat displays include a liquid crystal display (LCD), a plasma display panel (PDP), a field emission display (FED), an electroluminescent display (ELD), an electro wetting display (EWD), and an organic light emitting diode (OLED) display.

Particularly, an organic light emitting display device displays an image using an organic light emitting diode corresponding to each sub-pixel. In addition, the organic light emitting display device includes a plurality of unit pixels each including two or more sub-pixels corresponding to different colors to display a color image.

Such an organic light emitting diode is gradually deteriorated with increasing usage. In other words, luminance values of sub-pixels are different depending upon the usage of each sub-pixel. As a result, uniformity in luminance of the sub-pixels and reliability of the sub-pixels can be deteriorated, causing deterioration in image quality.

For an organic light emitting display device displaying color images, each of two or more sub-pixels included in each unit pixel includes an organic light emitting diode emitting white light and color filters corresponding to different colors.

Generally, the organic light emitting diode emitting white light includes a first organic light emitting layer corresponding to yellow light, which is a mixture of red light and green light, and a second organic light emitting layer corresponding to blue light.

Here, the first and second organic light emitting layers are different in degree of temperature-induced deterioration. As a result, the color temperature of white light emitted from an organic light emitting diode of each sub-pixel can be changed depending upon temperature around the organic light emitting diode and a period of time for which the temperature is maintained, thereby causing deterioration in image quality.

BRIEF SUMMARY

It is an object of the present invention to provide an organic light emitting display device which can compensate for variation in color temperature of white light depending upon temperature around an organic light emitting diode, and a method for driving the same.

The present invention is not limited to the above object and other objects and advantages of the present invention will become apparent from the following description of embodiments of the present invention. Furthermore, it can be easily understood that the objects and advantages of the present invention can be realized by features and combinations thereof disclosed in the claims.

In accordance with one aspect of the present invention, an organic light emitting display device includes a display panel including a plurality of unit pixels arranged in matrix form in a display area and each including at least three sub-pixels corresponding to different colors and an organic light emitting diode corresponding to each of the sub-pixels; and a deterioration compensation unit generating deterioration estimation data of each of the sub-pixels based on cumulative data of each of the sub-pixels, generating first and second temperature deterioration data based on display temperature data corresponding to temperature of the organic light emitting display device, calculating an individual compensation gain corresponding to each of the sub-pixels based on the deterioration estimation data and the first and second temperature deterioration data, and correcting input data of each of the sub-pixels based on the individual compensation gain of each of the sub-pixels.

The deterioration compensation unit may include a deterioration estimation data generation unit generating deterioration estimation data of each of the sub-pixels based on the cumulative data of each of the sub-pixels; a temperature deterioration data generation unit generating the first and second temperature deterioration data based on the display temperature data corresponding to the temperature of the organic light emitting display device; an individual compensation gain calculation unit calculating the individual compensation gain of each of the sub-pixels based on the deterioration estimation data, the first and second temperature deterioration data; and an individual compensation unit correcting the input data of each of the sub-pixels according to the individual compensation gain of each of the sub-pixels to generate input correction data of each of the sub-pixels.

The temperature deterioration data generation unit may accumulate first stress data when the display temperature data is higher than or equal to a predetermined threshold temperature in a predetermined measurement cycle, accumulate second stress data when the display temperature data is less than the threshold temperature in the predetermined measurement cycle, generate the first temperature deterioration data based on the accumulated first stress data, and generate the second temperature deterioration data based on the accumulated second stress data.

In accordance with another aspect of the present invention, there is provided a method for driving an organic light emitting display device including a plurality of unit pixels arranged in matrix form in a display area and each including at least three sub-pixels corresponding to different colors and an organic light emitting diode corresponding to each of the sub-pixels. The method includes generating deterioration estimation data of each of the sub-pixels based on cumulative data of each of the sub-pixels; accumulating first stress data when display temperature data corresponding to a temperature of the organic light emitting display device is higher than or equal to a predetermined threshold temperature in a predetermined measurement cycle; accumulating second stress data when the display temperature data is less than the threshold temperature in the predetermined measurement cycle; generating first temperature deterioration data based on the accumulated first stress data; generating second temperature deterioration data based on the accumulated second stress data; calculating an individual compensation gain of each of the sub-pixels based on the deterioration estimation data of each of the sub-pixels and the first and second temperature deterioration data; and generating input correction data of each of the sub-pixels by correcting input data of each of the sub-pixels according to the individual compensation gain of each of the sub-pixels.

The organic light emitting display device according to the present invention can estimate degrees of deterioration of first and second organic light emitting layers according to temperature around an organic light emitting diode to generate first and second temperature deterioration data. In addition, the organic light emitting display device can calculate an individual compensation gain of each sub-pixel based on deterioration estimation data of each sub-pixel and the first and second temperature deterioration data.

Thus, even when there is a difference in degree of deterioration between the first and second organic light emitting layers of a sub-pixel emitting white light depending upon ambient temperature, the color temperature of white light can be kept constant. As a result, it is possible to prevent usage-dependent deterioration in image quality and reliability.

BRIEF DESCRIPTION OF THE DRAWINGS

The above and other aspects, features, and advantages of the present invention will become apparent from the detailed description of the following embodiments in conjunction with the accompanying drawings, in which.

DETAILED DESCRIPTION

Hereinafter, an organic light emitting display device according to one or more embodiments of the present invention and a method for driving the same according to one or more embodiments of the present invention will be described in detail with reference to the accompanying drawings. All components of the organic light emitting display device according to all embodiments of the present invention are operatively coupled and configured.

First, an organic light emitting display device according to one embodiment of the present invention will be described with reference to FIGS. 1 and 2.

Figure 1:
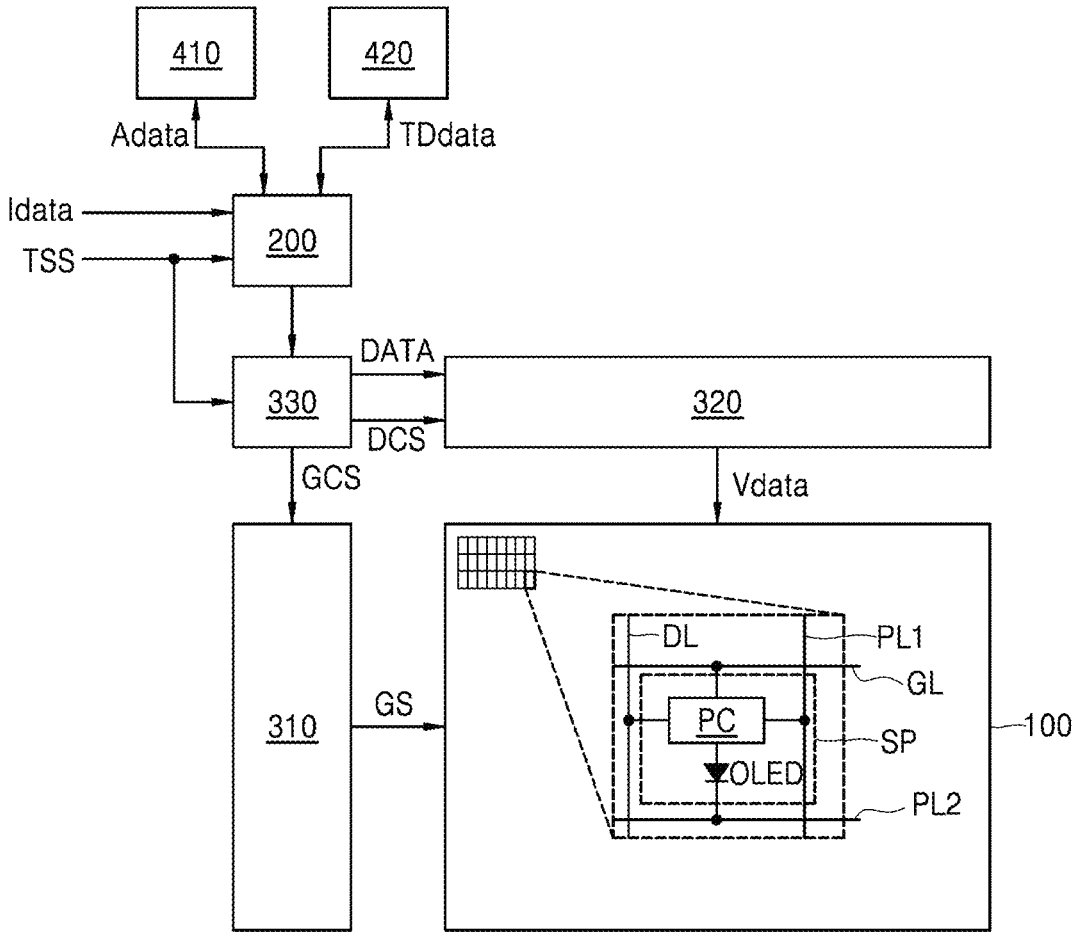
FIG. 1 is a schematic diagram of an organic light emitting display device according to one embodiment of the present invention.

More specifically, FIG. 1 is a schematic diagram of an organic light emitting display device according to one embodiment of the present invention. FIG. 2 is an equivalent circuit diagram corresponding to each sub-pixel of FIG. 1.

Referring to FIG. 1, the organic light emitting display device according to this embodiment includes a display panel 100, a deterioration compensation unit 200, a gate driver 310, a data driver 320, a timing controller 330, a first memory 410, and a second memory 420.

The display panel 100 includes a plurality of unit pixels arranged in matrix form in a display area where an image is displayed. Each of the unit pixels includes three or more sub-pixels SP corresponding to different colors.

Each of the sub-pixels SP is disposed in a pixel area defined by a gate line GL and a data line DL crossing each other. Each of the sub-pixels SP includes an organic light emitting diode OLED and a pixel circuit PC driving the organic light emitting diode.

In addition, the display panel 100 further includes: a gate line GL and a second power line PL2 both disposed in a first direction (the horizontal direction in FIG. 1); and a data line DL and a first power line PL1 both disposed in a second direction (the vertical direction in FIG. 1).

The gate line GL serves to apply a gate signal GS to each of the sub-pixels SP and the data line DL serves to apply a data signal Vdata to each of the sub-pixels SP. The first power line PL1 serves to apply a first drive power to each of the sub-pixels SP and the second power line PL2 serves to apply a second drive power to each of the sub-pixels SP.

The organic light emitting diode OLED of each of two or more sub-pixels SP included in each unit pixel may be a white light emitting diode.

Further, the organic light emitting diode OLED may include a first organic light emitting layer corresponding to yellow light, which is a mixture of red light and green light, and a second organic light emitting layer corresponding to blue light.

In this structure, the two or more sub-pixels SP further include color filters corresponding to different colors, respectively. For example, the two or more sub-pixels SP included in each unit pixel may include first, second, third, and fourth sub-pixels corresponding to red, green, blue, and white colors, respectively.

The first sub-pixel corresponding to a red color includes an organic light emitting diode OLED emitting white light and a first color filter corresponding to a red light. The first color filter transmits a red light component of white light but filters out other components. The second sub-pixel corresponding to a green color includes an organic light emitting diode OLED emitting white light and a second color filter corresponding to green light. The second color filter transmits a green light component of white light but filters out other components. The third sub-pixel corresponding to a blue color includes an organic light emitting diode OLED emitting white light and a third color filter corresponding to a blue light. The third color filter transmits a blue light component of white light but filters out other components. The fourth sub-pixel corresponding to a white color includes an organic light emitting diode OLED emitting white light and a fourth color filter transmitting white light.

Figure 2:
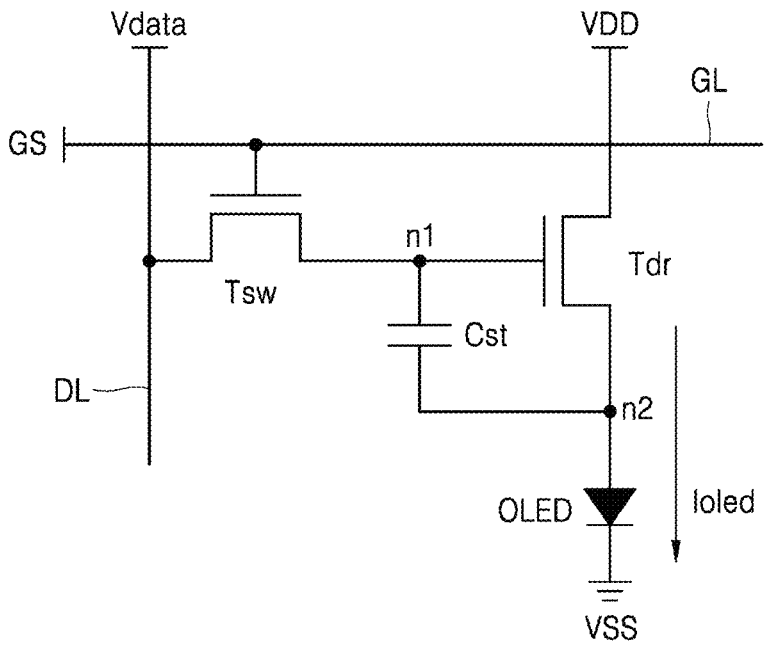
FIG. 2 is an equivalent circuit diagram corresponding to each sub-pixel of FIG. 1.

Referring to FIG. 2, the pixel circuit of each of the sub-pixels SP includes a switching transistor Tsw, a driving transistor Tdr, and a storage capacitor Cst.

The switching transistor Tsw is connected to the gate line GL, the data line DL and the driving transistor Tdr. The switching transistor Tsw transmits the data signal Vdata of the data line DL to the driving transistor Tdr and the storage capacitor Cst when turned on based on the gate signal GS of the gate line GL.

The storage capacitor Cst is connected between a gate terminal and a source terminal of the driving transistor Tdr and is charged in response to the data signal Vdata supplied from the turned-on switching transistor Tsw.

The driving transistor Tdr is turned on in response to the data signal Vdata and a charging voltage of the storage capacitor Cst. A current path between first and second drive power supplies VDD, VSS is created by the turned-on driving transistor Tdr to allow a driving current Ioled to be supplied to the organic light emitting diode OLED.

Returning to FIG. 1, the deterioration compensation unit 200 corrects input data of each of the sub-pixels SP according to a degree of deterioration of each of the sub-pixels SP to generate input modulation data Mdata of each of the sub-pixels SP.

Specifically, the deterioration compensation unit 200 generates deterioration estimation data of each of the sub-pixels SP based on cumulative data of each of the sub-pixels SP. The deterioration compensation unit 200 generates first and second temperature deterioration data based on display temperature data corresponding to temperature of the organic light emitting display device. The deterioration compensation unit 200 calculates an individual compensation gain corresponding to each of the sub-pixels SP based on the deterioration estimation data and the first and second temperature deterioration data. The deterioration compensation unit 200 corrects the input data Idata of each of the sub-pixels SP according to the individual compensation gain of each of the sub-pixels SP to generate input correction data of each of the sub-pixels SP. The deterioration compensation unit 200 calculates a global compensation gain based on the cumulative data of all of the sub-pixels SP and generates the input modulation data Mdata of each of the sub-pixels SP based on the global compensation gain. Details of the deterioration compensation unit 200 will be described further below.

The gate driver 310 supplies the gate signal GS to each of the sub-pixels SP through the gate line GL. In other words, the gate driver 310 supplies the gate signal GS to each of the sub-pixels SP based on a gate control signal GCS from the timing controller 330.

The data driver 320 supplies the data signal Vdata to the plurality of sub-pixels SP through the data line DL. Here, the data signal Vdata corresponds to an output value of the deterioration compensation unit 200. In other words, the data driver 320 generates the data signal Vdata of each of the sub-pixels SP corresponding to the input modulation data Mdata of each of the sub-pixels SP output from the deterioration compensation unit 200.

The data driver 320 supplies the data signal Vdata to each of the sub-pixels SP based on pixel data DATA and the data control signal DCS from the timing controller 330. For example, the data driver 320 may convert the pixel data DATA into an analog-type data signal Vdata using a plurality of reference gamma voltages according to a data control signal DCS and supply the data signal Vdata to each of the sub-pixels SP.

The timing controller 330 controls driving of the gate driver 310 and the data driver 320.

For example, the timing controller 330 generates the gate control signal GCS and the data control signal DCS based on a timing synchronization signal TSS input from the outside. The gate control signal GCS serves to control driving of the gate driver 310 and the data control signal DCS serves to control driving of the data driver 320. Here, the timing synchronization signal TSS may include a vertical synchronization signal, a horizontal synchronization signal, a data enable signal, a dot clock, and the like.

The timing controller 330 aligns the input modulation data Mdata output from the deterioration compensation unit 200 with pixel arrangement of the display panel 100. The timing controller 330 supplies the aligned pixel data DATA to the data driver 320.

The deterioration compensation unit 200 may be a component of the timing controller 330. In other words, the deterioration compensation unit 200 may be a program or logic embedded in the timing controller 330.

The first memory 410 stores the cumulative data Adata of each of the sub-pixels SP generated by the deterioration compensation unit 200.

The second memory 420 stores first and second stress data TDdata accumulated by the deterioration compensation unit 200.

Next, a deterioration compensation unit according to one embodiment of the present invention and a method for driving an organic light emitting display device including the same will be described with reference to FIGS. 3 and 4.

Figure 3:
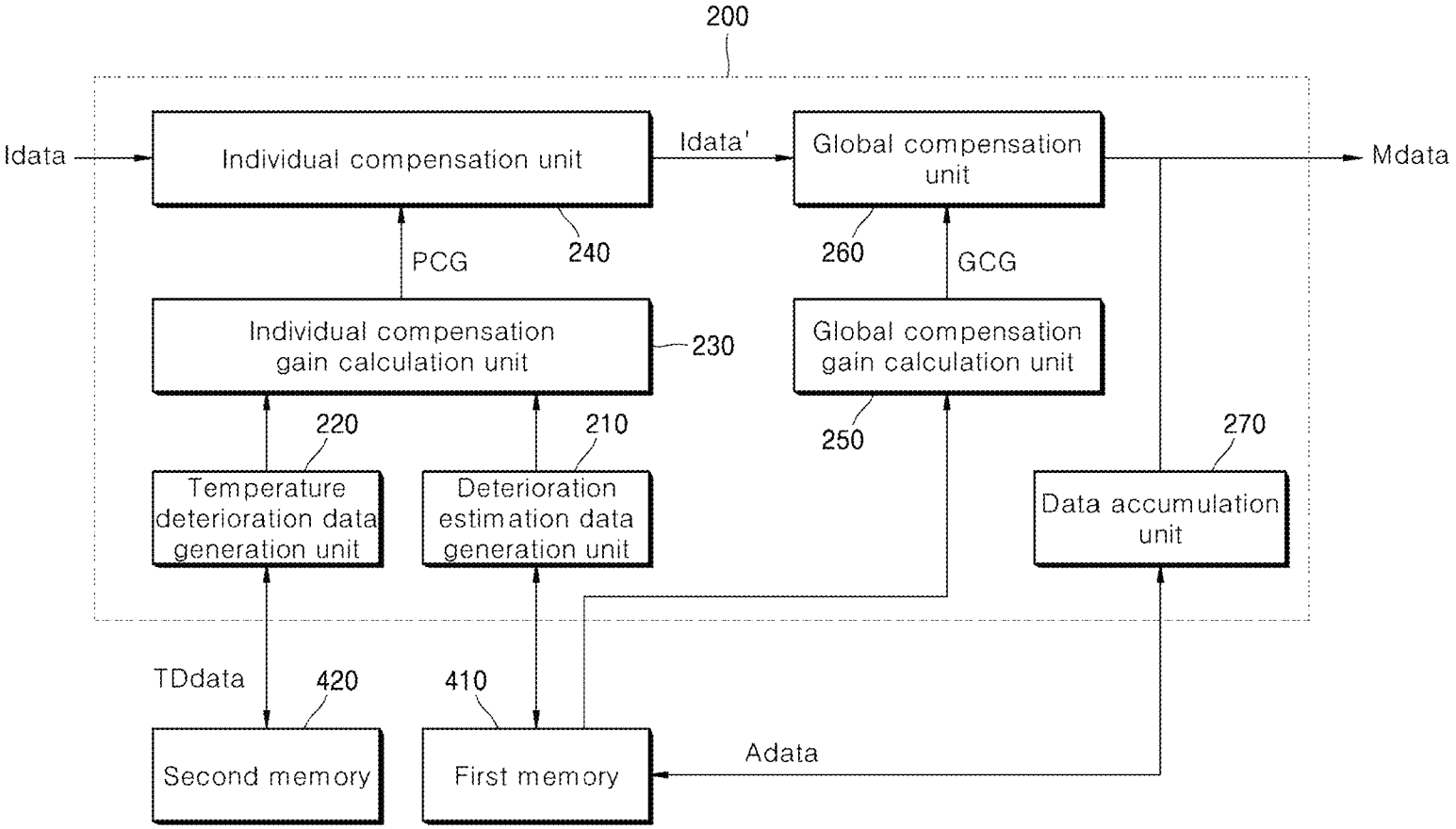
FIG. 3 is a diagram of a deterioration compensation unit of FIG. 1.

FIG. 3 is a diagram of the deterioration compensation unit of FIG. 1. FIG. 4 is a flowchart illustrating a method for driving an organic light emitting display device according to one embodiment of the present invention.

Referring to FIG. 3, the deterioration compensation unit 200 according to this embodiment includes: a deterioration estimation data generation unit 210, a temperature deterioration data generation unit 220, an individual compensation gain calculation unit 230, an individual compensation unit 240, a global compensation gain calculation unit 250, a global compensation unit 260, and a data accumulation unit 270.

The deterioration estimation data generation unit 210 generates deterioration estimation data of each of the sub-pixels based on the cumulative data Adata of each of the sub-pixels. Here, the deterioration estimation data may be generated by estimating a degree of deterioration of the sub-pixel corresponding to the cumulative data using data modeling of a degree of usage-dependent deterioration of the organic light emitting diode.

The temperature deterioration data generation unit 220 generates the first and second temperature deterioration data based on display temperature data corresponding to the temperature inside or outside the organic light emitting display device. Here, the first and second temperature deterioration data may be generated by estimating a degree of deterioration of each of the first and second organic light emitting layers using data modeling of the degree of deterioration of each of the first and second organic light emitting layers according to temperature around the organic light emitting diode and usage of the organic light emitting diode, wherein the degree of deterioration corresponds to the display temperature data and a period of time for which the display temperature data is maintained.

For example, the temperature deterioration data generation unit 220 accumulates the first stress data stored in the second memory 420 when the display temperature data is higher than or equal to a predetermined threshold temperature in a predetermined measurement cycle, and accumulates the second stress data stored in the second memory 420 when the display temperature data is less than the predetermined threshold temperature in the predetermined measurement cycle.

Here, the first stress data is provided to count usage of the first organic light emitting layer of the organic light emitting diode emitting white light at a temperature higher than or equal to the threshold temperature TH_T, in which the first organic light emitting layer corresponds to yellow light.

The second stress data is provided to count usage of the second organic light emitting layer of the organic light emitting diode emitting white light at a temperature less than the threshold temperature TH_T, in which the second organic light emitting layer corresponds to blue light.

Here, the first organic light emitting layer corresponds to yellow light, which is a mixture of red light and green light, and the second organic light emitting layer corresponds to blue light.

The threshold temperature may be set to a temperature at which the first organic light emitting layer is more deteriorated than the second organic light emitting layer, as determined through experimentation. For example, the threshold temperature may be about 60° C.

The temperature deterioration data generation unit 220 generates the first temperature deterioration data corresponding to the accumulated first stress data and the second temperature deterioration data corresponding to the accumulated second stress data.

Here, the first and second temperature deterioration data may be generated using a predetermined lookup table created through data modeling for estimating degrees of deterioration of the first and second organic light emitting layers corresponding to the first and second stress data.

The individual compensation gain calculation unit 230 calculates the individual compensation gain PCG of each of the sub-pixels based on the deterioration estimation data of each of the sub-pixels and the first and second temperature deterioration data.

That is, the individual compensation gain calculation unit 230 calculates the individual compensation gain of each of the sub-pixels based on the deterioration estimation data of each of the sub-pixels. In addition, the individual compensation gain calculation unit 230 calculates the individual compensation gain of at least one of the first and second sub-pixels which emit red light and green light, respectively, based on the first temperature deterioration data. Further, the individual compensation gain calculation unit 230 calculates the individual compensation gain of the third sub-pixel that emits blue light, based on the second temperature deterioration data. Moreover, the individual compensation gain calculation unit 230 calculates the individual compensation gain of the fourth sub-pixel that emits white light, based on the deterioration estimation data of the fourth sub-pixel.

For example, the individual compensation gain of the first sub-pixel may be calculated based on the deterioration estimation data of the first sub-pixel and the first temperature deterioration data, and the individual compensation gain of the second sub-pixel may be calculated based on the deterioration estimation data of the second sub-pixel and the first temperature deterioration data. In addition, the individual compensation gain of the third sub-pixel may be calculated based on the deterioration estimation data of the third sub-pixel and the second temperature deterioration data, and the individual compensation gain of the fourth sub-pixel may be calculated based on the deterioration estimation data of the fourth sub-pixel.

In this way, it is possible to compensate for difference in degree of deterioration between the first and second organic light emitting layers of the organic light emitting diode emitting white light depending upon the ambient temperature.

That is, according to this embodiment, when the first organic light emitting layer emitting yellow light is more deteriorated than the second organic light emitting layer at a high temperature higher than or equal to the threshold temperature, the individual compensation gain of at least one of the first and second sub-pixels that correspond to red light and green light, respectively, is increased. In contrast, when the second organic light emitting layer emitting blue light is more deteriorated than the first organic light emitting layer at a temperature less than the threshold temperature, the individual compensation gain of the third sub-pixel corresponding to a blue color is increased.

Since the data signal supplied to each of the sub-pixels corresponds to the individual compensation gain of each of the sub-pixels, the data signal supplied to each of the sub-pixels can be adjusted according to the first and second temperature deterioration data respectively corresponding to the degrees of deterioration of the first and second organic light emitting layers. Thus, it is possible to compensate for difference in degree of deterioration between the first and second organic light emitting layers by adjusting luminance of the first and second sub-pixels or by adjusting luminance of the third sub-pixel. As a result, the color temperature of white light can be kept constant.

In addition, the individual compensation gain of each of the sub-pixels calculated by the individual compensation gain calculation unit 230 may be a real number greater than or equal to 1.

The individual compensation unit 240 corrects the input data Idata of each of the sub-pixels according to the individual compensation gain PCG of each of the sub-pixels to generate input correction data Idata' of each of the sub-pixels.

For example, the input correction data Idata' generated by the individual compensation unit 240 may be a product of the input data Idata and the individual compensation gain PCG. However, it should be understood that this has been presented by way of example only and operation of correcting the input data Idata based on the individual compensation gain PCG may vary indifferent situations.

The global compensation gain calculation unit 250 calculates the global compensation gain GCG corresponding to all of the sub-pixels based on any one of maximum cumulative data, average cumulative data, and minimum cumulative data corresponding to the cumulative data of all of the sub-pixels. Here, the global compensation gain GCG is provided for collectively adjusting data signals of all of the sub-pixels and may be a real number greater than or equal to 0 and less than 1.

For example, the global compensation gain calculation unit 250 detects the maximum cumulative data, which is a maximum value of the cumulative data of all of the sub-pixels. Then, the global compensation gain calculation unit 250 may calculate the global compensation gain GCG based on the maximum cumulative data. In this case, luminances of all of the sub-pixels are reduced corresponding to the global compensation gain GCG based on the maximum cumulative data, whereby a deterioration rate of the organic light emitting diode of the sub-pixel corresponding to the maximum cumulative data can be decreased.

Alternatively, the global compensation gain calculation unit 250 detects the average cumulative data, which is an average value of the cumulative data of all of the sub-pixels. Then, the global compensation gain calculation unit 250 may calculate the global compensation gain GCG based on the average cumulative data. Alternatively, the global compensation gain calculation unit 250 may detect the minimum cumulative data, which is a minimum value of the cumulative data of all of the sub-pixels. Then, the global compensation gain calculation unit 250 may calculate the global compensation gain GCG based on the minimum cumulative data.

The global compensation unit 260 modulates the input correction data Idata' of each of the sub-pixels according to the global compensation gain GCG to generate the input modulation data Mdata of each of the sub-pixels. For example, the input modulation data Mdata generated by the global compensation unit 260 may be a product of the input correction data Idata' and the global compensation gain GCG. However, it should be understood that this has been presented by way of example only and operation of modulating the input correction data Idata' based on the global compensation gain GCG may vary indifferent situations.

The data accumulation unit 270 sums the input correction data Mdata output from the global compensation unit 260 and updates the cumulative data Adata of each of the sub-pixels stored in the first memory 410.

Figure 4:
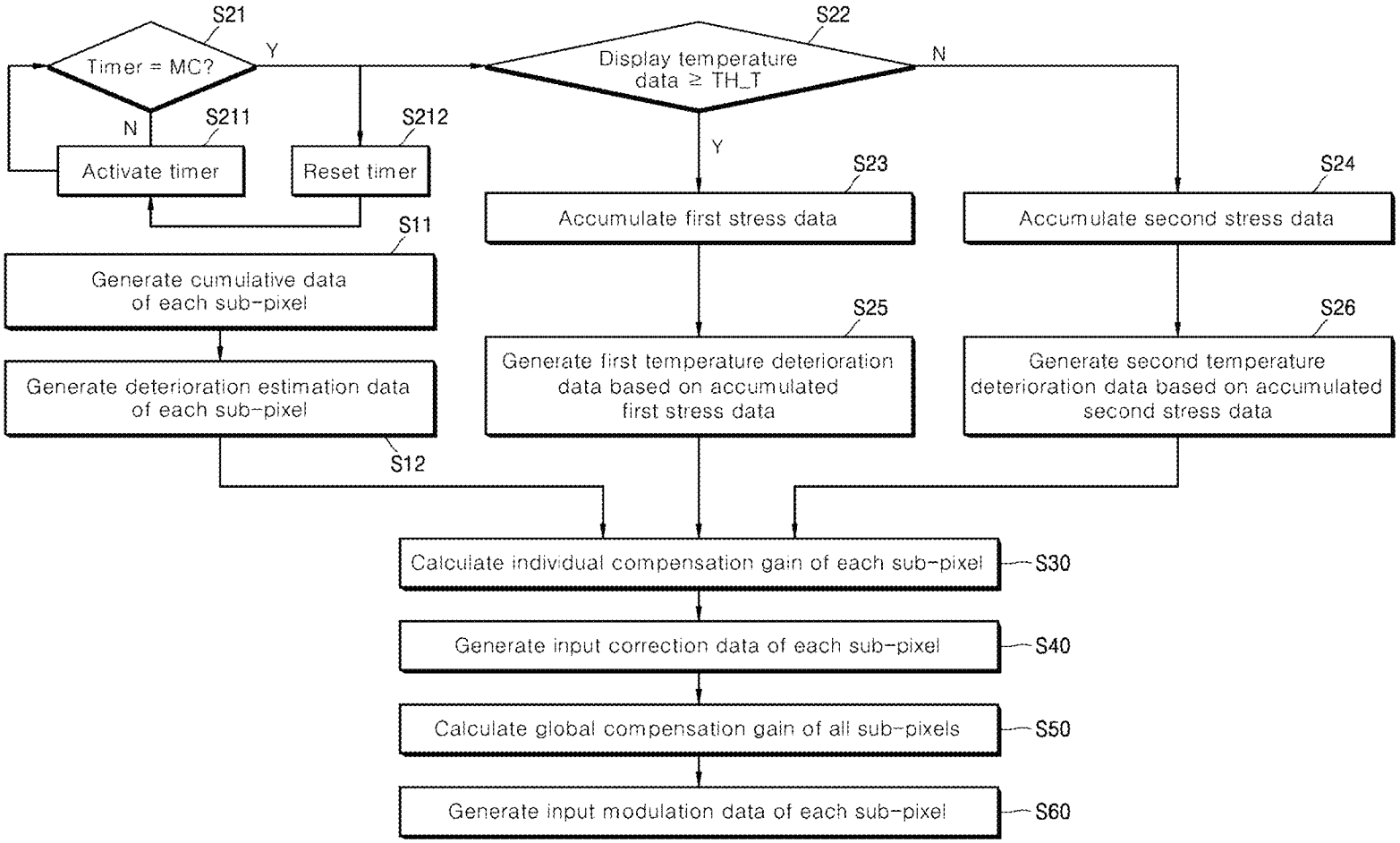
FIG. 4 is a flowchart illustrating a method for driving an organic light emitting display device according to one embodiment of the present invention.

Referring to FIG. 4, a method for driving an organic light emitting display device according to one embodiment of the invention includes: generating cumulative data of each sub-pixel (S11); generating deterioration estimation data of each sub-pixel based on the cumulative data of each sub-pixel (S12); accumulating first stress data corresponding to a degree of deterioration of a first organic light emitting layer included in an organic light emitting diode of a sub-pixel corresponding to a white color (S23) when display temperature data corresponding to a temperature of the organic light emitting display device is higher than or equal to a predetermined threshold temperature (S22) in a predetermined measurement cycle (S21); accumulating second stress data corresponding to a degree of deterioration of a second organic light emitting layer included in the organic light emitting diode of the sub-pixel corresponding to the white color (S24) when the display temperature data is less than the predetermined threshold temperature (S22) in the predetermined measurement cycle (S21); generating first temperature deterioration data based on the accumulated first stress data (S25); generating second temperature deterioration data based on the accumulated second stress data (S26); calculating an individual compensation gain of each sub-pixel based on the deterioration estimation data of each sub-pixel and the first and second temperature deterioration data (S30); generating input correction data of each sub-pixel by correcting input data of each sub-pixel according to the individual compensation gain of each sub-pixel (S40); calculating a global compensation gain corresponding to all of the sub-pixels based on the cumulative data of all of the sub-pixels (S50); and generating input modulation data of each sub-pixel by modulating the input data of each sub-pixel according to the global compensation gain (S60).

Specifically, a data accumulation unit 270 accumulates the input modulation data Mdata of each sub-pixel supplied to a timing controller 200 to generate the cumulative data Adata of each sub-pixel and then supplies the cumulative data to a first memory 410 (S11). That is, the first memory 410 stores the cumulative data Adata of each sub-pixel.

A deterioration estimation data generation unit 210 generates the deterioration estimation data of each sub-pixel based on the cumulative data Adata of each sub-pixel stored in the first memory 410 (S12). Here, the deterioration estimation data is an estimate of a degree of usage-dependent deterioration of an organic light emitting diode of each sub-pixel.

A temperature deterioration data generation unit 220 includes a timer for counting a measurement cycle MC. If the timer does not indicate the measurement cycle MC (S21), the temperature deterioration data generation unit 220 activates the timer (S211). If the timer indicates the measurement cycle MC (S21), the temperature deterioration data generation unit 220 resets the timer (S212) and compares the display temperature data with the predetermined threshold temperature TH_T (S22).

The temperature deterioration data generation unit 220 accumulates the first stress data stored in a second memory 420 when the display temperature data is higher than or equal to the threshold temperature TH_T in the predetermined measurement cycle MC (S23). On the other hand, the temperature deterioration data generation unit 220 accumulates the second stress data stored in the second memory 420 when the display temperature data is less than the threshold temperature TH_T in the predetermined measurement cycle MC (S24).

Here, the first stress data is provided to count usage of a first organic light emitting layer of an organic light emitting diode emitting white light at a temperature higher than or equal to the threshold temperature TH_T, in which the first organic light emitting layer corresponds to yellow light.

The second stress data is provided to count usage of a second organic light emitting layer of the organic light emitting diode emitting white light at a temperature less than the threshold temperature TH_T, in which the second organic light emitting layer corresponds to blue light.

The threshold temperature is set to a temperature at which the first organic light emitting layer is more deteriorated than the second organic light emitting layer. For example, the threshold temperature may be about 60° C.

The second memory 420 stores the accumulated first and second stress data.

The temperature deterioration data generation unit 220 generates the first temperature deterioration data corresponding to the first stress data (S25) and the second temperature deterioration data corresponding to the second stress data (S26). Here, the first temperature deterioration data corresponds to an estimate of a degree of deterioration of the first organic light emitting layer, and the second temperature deterioration data corresponds to an estimate of a degree of deterioration of the second organic light emitting layer.

An individual compensation gain calculation unit 230 calculates the individual compensation gain PCG of each sub-pixel based on the deterioration estimation data of each sub-pixel and the first and second temperature deterioration data (S30).

Here, the individual compensation gain PCG of at least one of a first sub-pixel and a second sub-pixel respectively corresponding to red light and green light among two or more sub-pixels included in each unit pixel is calculated based on the deterioration estimation data of each of the first and second sub-pixels and the first temperature deterioration data.

In addition, the individual compensation gain PCG of a third sub-pixel corresponding to a blue color is calculated based on the deterioration estimation data of the third sub-pixel and the second temperature deterioration data.

An individual compensation unit 240 generates the input correction data Idata' of each sub-pixel by correcting the input data Idata of each sub-pixel according to the individual compensation gain PCG of each sub-pixel (S40).

A global compensation gain calculation unit 250 calculates the global compensation gain corresponding to all of the sub-pixels based on the cumulative data Adata of each sub-pixel (S50).

For example, the global compensation gain may be calculated based on any one of the maximum value, the average value, and the minimum value among the cumulative data of all of the sub-pixels.

A global compensation unit 260 modulates the input correction data of each sub-pixel according to the global compensation gain to generate the input modulation data Mdata of each sub-pixel (S60).

As described above, the deterioration compensation unit 200 of the organic light emitting display device according to one embodiment of the invention estimates the degrees of deterioration of the first and second organic light emitting layers according to temperature around the organic light emitting diode to generate the first and second temperature deterioration data. In addition, the deterioration compensation unit calculates the individual compensation gain of at least one of the first and second sub-pixels respectively emitting red light and green light, based on both the deterioration estimation data of each of the first and second sub-pixels and the first temperature deterioration data corresponding to the degree of deterioration of the first organic light emitting layer corresponding to yellow light. Further, the deterioration compensation unit calculates the individual compensation gain of the third sub-pixel emitting blue light, based on the deterioration estimation data of the third sub-pixel and the second temperature deterioration data corresponding to the degree of deterioration of the second organic light emitting layer corresponding to blue light.

In this way, in the organic light emitting diode emitting white light, when the first organic light emitting layer emitting yellow light is more deteriorated than the second organic light emitting layer emitting blue light due to ambient temperature higher than or equal to the threshold temperature, the individual compensation gain of at least one of the first and second sub-pixels that emit red light and green light, respectively, is adjusted to increase luminance of at least one of the first and second sub-pixels, thereby preventing white light from having a color temperature biased to a blue color.

In addition, in the organic light emitting diode emitting white light, when the second organic light emitting layer emitting blue light is more deteriorated than the first organic light emitting layer due to ambient temperature less than the threshold temperature, the individual compensation gain of the third sub-pixel that emits blue light is adjusted to increase luminance of the third sub-pixel, thereby preventing white light from having a color temperature biased to a yellow color.

In this way, difference in degree of deterioration between the first and second organic light emitting layers due to the ambient temperature can be compensated, thereby preventing change in color temperature of white light.

This effect will be described in more detail with reference to FIGS. 5 to 9.

Figure 5:
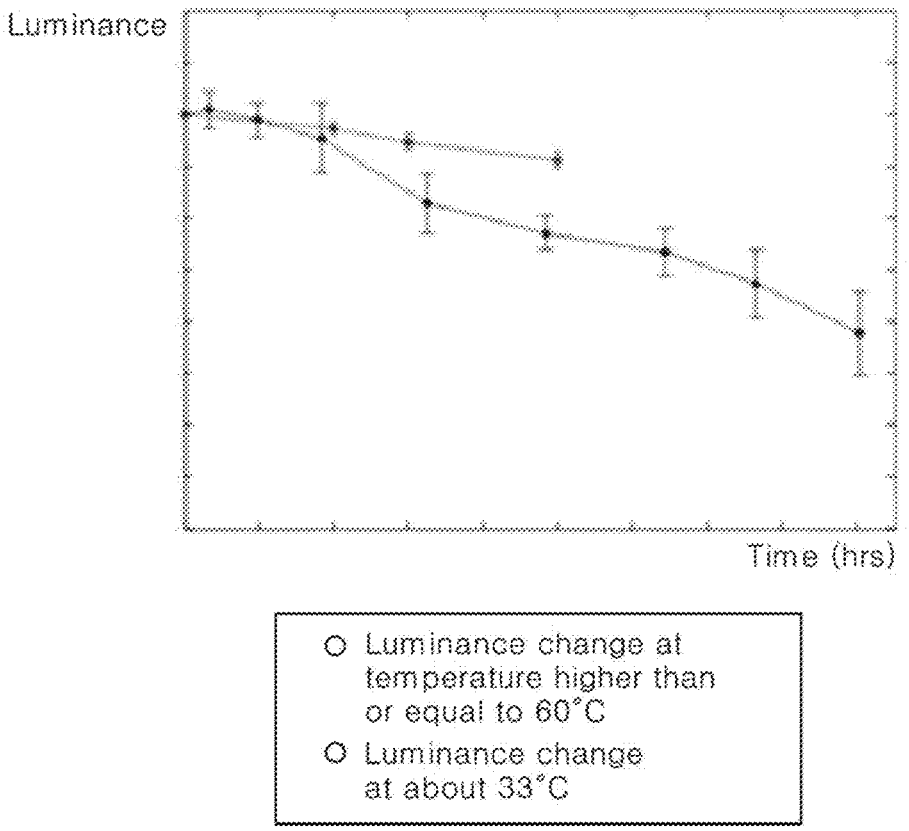
FIG. 5 is a graph showing difference in luminance change according to ambient temperature.
Figure 6:
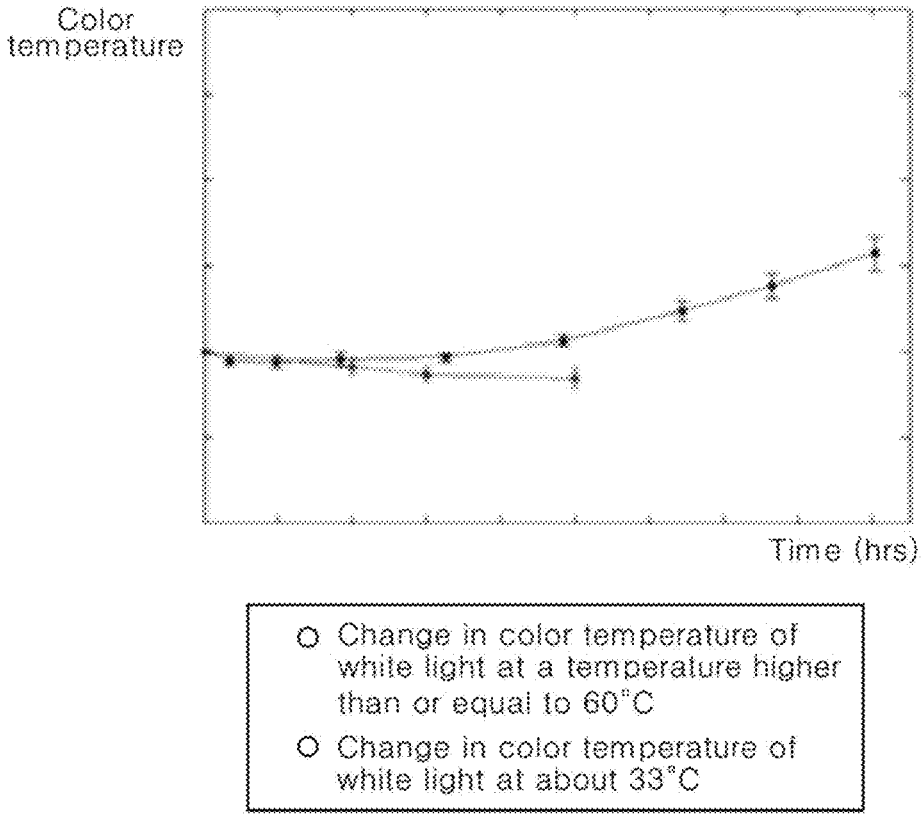
FIG. 6 is a graph showing difference in change of color temperature according to ambient temperature.
Figure 7:
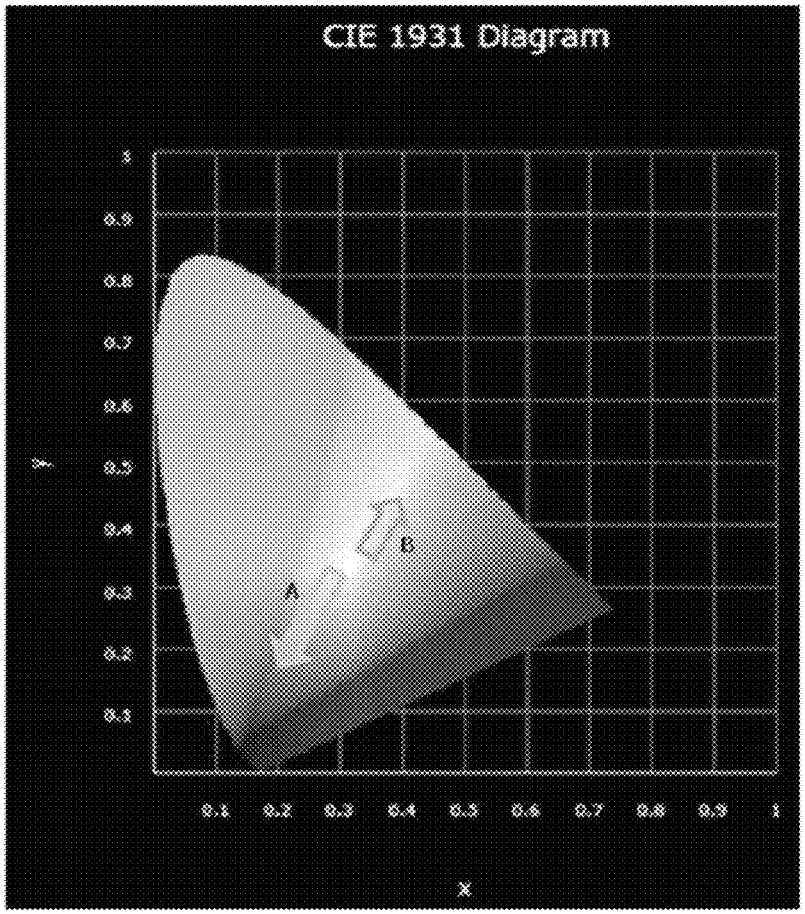
FIG. 7 is a diagram showing direction of change of color temperature according to ambient temperature in a color coordinate system.
Figure 8:
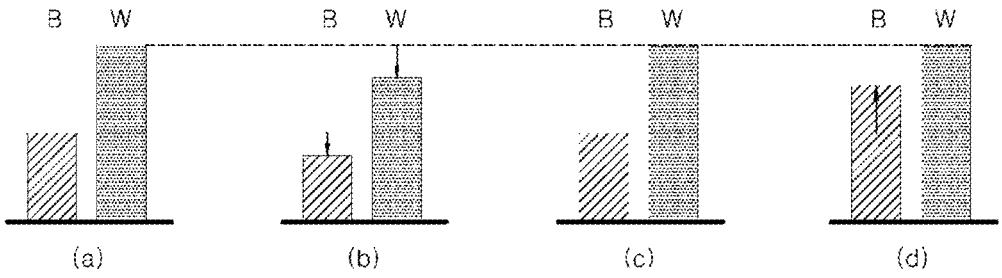
FIG. 8 is a schematic view showing luminances of a sub-pixel corresponding to a red or green color and a sub-pixel corresponding to a white color, as measured immediately after the sub-pixels are fabricated, after the sub-pixels are deteriorated, after compensation according to the deterioration estimation data, and after compensation according to the deterioration estimation data and the first temperature deterioration data.
Figure 9:
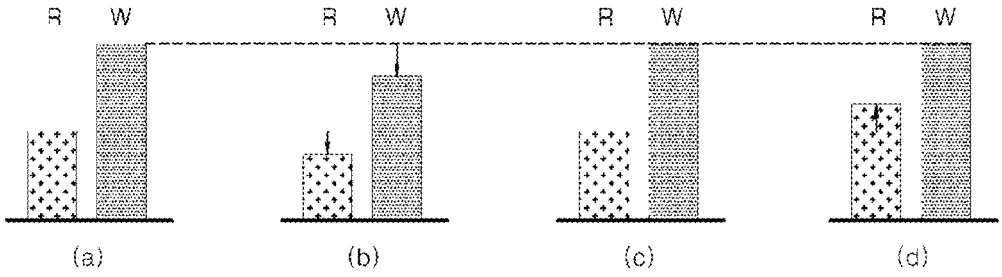
FIG. 9 is a schematic view showing luminances of a sub-pixel corresponding to a blue color and a sub-pixel corresponding to a white color, as measured immediately after the sub-pixels are fabricated, after the sub-pixels are deteriorated, after compensation according to the deterioration estimation data, and after compensation according to the deterioration estimation data and the second temperature deterioration data.

FIG. 5 is a graph showing difference in luminance change according to ambient temperature. FIG. 6 is a graph showing difference in change of color temperature according to ambient temperature. FIG. 7 is a diagram showing direction of change of color temperature according to ambient temperature in a color coordinate system. FIG. 8 is a schematic view showing luminances of a sub-pixel corresponding to a red or green color and a sub-pixel corresponding to a white color, as measured immediately after the sub-pixels are fabricated, after the sub-pixels are deteriorated, after compensation according to the deterioration estimation data, and after compensation according to the deterioration estimation data and the first temperature deterioration data. FIG. 9 is a schematic view showing luminances of a sub-pixel corresponding to a blue color and a sub-pixel corresponding to a white color, as measured immediately after the sub-pixels are fabricated, after the sub-pixels are deteriorated, after compensation according to the deterioration estimation data, and after compensation according to the deterioration estimation data and the second temperature deterioration data.

Referring to FIG. 5, the organic light emitting diode deteriorates and luminance of the organic light emitting diode is gradually decreased over time. In addition, it can be seen that the luminance of the organic light emitting diode is more sharply decreased at an ambient temperature of 60° C. or higher than at an ambient temperature of about 33° C. In FIG. 5, the horizontal axis represents cumulative operation time and the vertical axis represents a ratio of luminance of the deteriorated organic light emitting diode to initial luminance of the organic light emitting diode.

Referring to FIG. 6, it can be seen that the color temperature of the organic light emitting diode gradually increases with increasing cumulative operation time when the ambient temperature is higher than or equal to 60° C., whereas the color temperature gradually decreases with increasing cumulative operation time when the ambient temperature is about 33° C. Here, the increase in color temperature means that the color temperature of white light becomes closer to blue light, and the decrease in color temperature means that the color temperature of white light becomes closer to a red or green color.

That is, as shown in FIG. 7, when the ambient temperature is higher than or equal to 60° C., the color temperature of white light is changed in Direction A, i.e., becomes closer to blue light. On the other hand, when the ambient temperature is a temperature of about 33° C., the color temperature of white light is changed in Direction B, i.e., becomes closer to a yellow color between red and green colors.

According to this embodiment, the color temperature of white light can be kept constant by changing luminances of the first, second and third sub-pixels of each unit pixel, which correspond to red, green and blue colors, respectively, to compensate for change in color temperature of white light depending upon the ambient temperature.

For example, for a given data signal, luminance B of blue light and luminance W of white light are decreased below initial values (FIG. 8(*a*)) with increasing cumulative operation time of the organic light emitting display device, as shown in FIG. 8(*b*).

The luminance B of blue light and the luminance W of white light can become similar to the initial values (FIG.

8(*a*)) by compensating for deterioration of the organic light emitting diode with increasing cumulative operation time of the organic light emitting display device, based on the deterioration estimation data of each sub-pixel, as shown in FIG. 8(*c*).

According to this embodiment, in the sub-pixel emitting white light, the luminance B of blue light may be increased above the initial value by compensating for difference in degree of deterioration between the second organic light emitting layer corresponding to blue light and the first organic light emitting layer corresponding to yellow light due to the temperature of the organic light emitting display device, based on the second temperature deterioration data. In this way, even when the second organic light emitting layer is more deteriorated than the first organic light emitting layer, the color temperature of white light can be kept constant without being biased to yellow light.

In addition, for a given data signal, luminance R of red light and luminance W of white light are decreased below the initial values (FIG. 9(*a*)) with increasing cumulative operation time of the organic light emitting display device, as shown in FIG. 9(*b*), The luminance R of red light and the luminance W of white light can become similar to the initial values (FIG. 9(*a*)) by compensating for deterioration of the organic light emitting diode with increasing cumulative operation time of the organic light emitting display device, based on the deterioration estimation data of each sub-pixel, as shown in FIG. 9(*c*).

Further, according to this embodiment, in the sub-pixel emitting white light, the luminance R of red light may be increased above the initial value by compensating for difference in degree of deterioration between the first organic light emitting layer corresponding to yellow light and the second organic light emitting layer corresponding to blue light due to the temperature of the organic light emitting display device, based on the first temperature deterioration data. In this way, even when the first organic light emitting layer is more deteriorated than the second organic light emitting layer, the color temperature of white light can be kept constant without being biased to blue light.

According to this embodiment, the input modulation data Mdata of each sub-pixel is generated based on the global compensation gain.

For example, the global compensation gain calculation unit 250 may detect the maximum value among the cumulative data Adata of all of the sub-pixels and calculate the global compensation gain based on the maximum cumulative data. According to the global compensation gain, the input correction data Idata' of all of the sub-pixels may be reduced.

Figure 10:
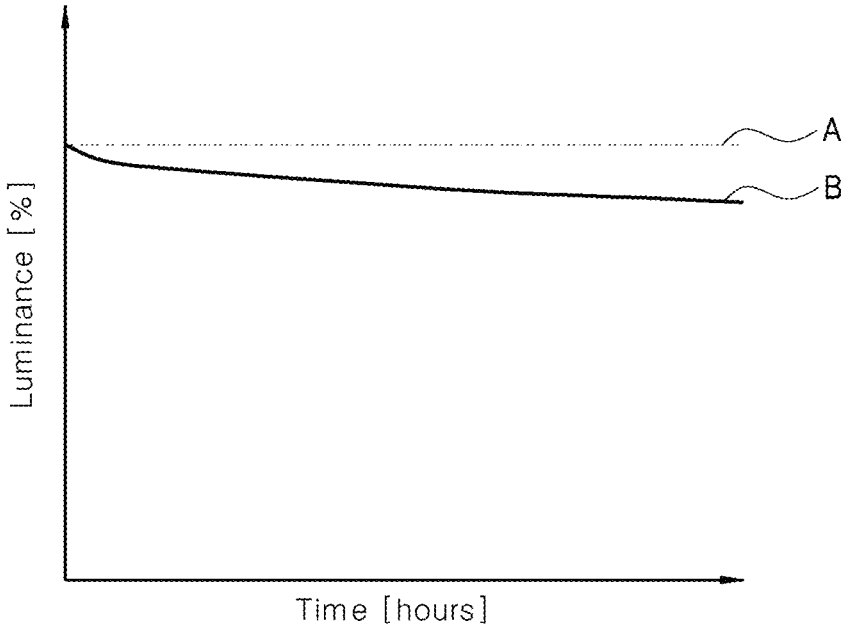
FIG. 10 is a graph showing luminance of a sub-pixel, as measured after compensation according to the individual compensation gain and after compensation according to the individual compensation gain and the global compensation gain.

FIG. 10 is a graph showing luminance of a sub-pixel, as measured after compensation according to the individual compensation gain and after compensation according to the individual compensation gain and the global compensation gain.

Referring to FIG. 10, when the global compensation gain is calculated based on the maximum cumulative data, the luminance B of the sub-pixel after compensation according to both the individual compensation gain and the global compensation gain is lower than the luminance A after compensation according to the individual compensation gain.

In this way, a rate of deterioration of an organic light emitting diode can be advantageously reduced. If a sub-pixel corresponding to the maximum cumulative data is operated to exhibit relatively high luminance according to a relatively large individual compensation gain, the sub-pixel can deteriorate more quickly than other sub-pixels, thereby causing failure of the display. According to this embodiment, the luminances of all of the sub-pixels may be adjusted according to the global compensation gain corresponding to all of the sub-pixels, whereby the deterioration rates of all of the sub-pixels can be relatively uniformly regulated, and thereby increasing lifespan of the display.

Although some embodiments have been described herein, it should be understood that these embodiments are provided for illustration only and are not to be construed in any way as limiting the present invention, and that various modifications, changes, alterations, and equivalent embodiments can be made by those skilled in the art without departing from the spirit and scope of the invention.

What is claimed is:

1. An organic light emitting display device, comprising:

a display panel comprising a plurality of unit pixels arranged in matrix form in a display area, each unit pixel comprising at least three sub-pixels corresponding to different colors and an organic light emitting diode corresponding to each of the sub-pixels;

a deterioration compensator configured to:

generate deterioration estimation data of each of the sub-pixels based on cumulative data of each of the sub-pixels, generate first and second temperature deterioration data based on display temperature data corresponding to temperature of the organic light emitting diode display, calculate an individual compensation gain corresponding to each of the sub-pixels based on the deterioration estimation data and the first or second temperature deterioration data, generate input modulation data of each of the sub-pixels by correcting input data of each of the sub-pixels based on the individual compensation gain of each of the sub-pixels, and generate the cumulative data of each of the sub-pixels by counting the input modulation data of each of the sub-pixels;

a gate driver configured to supply a scan signal to each of the sub-pixels;

a data driver configured to supply a data signal corresponding to an output value of the deterioration compensator to each of the sub-pixels; and a timing controller configured to control driving of each of the gate driver and the data driver, wherein the deterioration compensator comprises:

a temperature deterioration data generator configured to generate the first and second temperature deterioration data based on the display temperature data corresponding to the temperature of the organic light emitting display device, and wherein the temperature deterioration data generator accumulates first stress data when the display temperature data is higher than or equal to a predetermined threshold temperature in a predetermined measurement cycle, accumulates second stress data when the display temperature data is less than the predetermined threshold temperature in the predetermined measurement cycle, generates the first temperature deterioration data based on the accumulated first stress data, and generates the second temperature deterioration data based on the accumulated second stress data.

2. The organic light emitting display device according to claim 1, wherein the deterioration compensator further comprises:

a deterioration estimation data generator configured to generate deterioration estimation data of each of the sub-pixels based on the cumulative data of each of the sub-pixels;

an individual compensation gain calculator configured to calculate the individual compensation gain of each of the sub-pixels based on the deterioration estimation data and the first and second temperature deterioration data; and an individual compensator configured to correct the input data of each of the sub-pixels according to the individual compensation gain of each of the sub-pixels to generate input correction data of each of the sub-pixels.

3. The organic light emitting display device according to claim 2, wherein the first temperature deterioration data corresponds to a degree of deterioration of a first organic light emitting layer included in the organic light emitting diode, the second temperature deterioration data corresponds to a degree of deterioration of a second organic light emitting layer included in the organic light emitting diode, and wherein the first organic light emitting layer corresponds to mixture light of red and green light, and the second organic light emitting layer corresponds to blue light.

4. The organic light emitting display device according to claim 3, wherein each of the unit pixels comprises first, second, third, and fourth sub-pixels corresponding to red, green, blue, and white colors, respectively, and wherein the individual compensation gain calculator calculates the individual compensation gain of each of the sub-pixels based on the deterioration estimation data of each of the sub-pixels, calculates the individual compensation gain of at least one of the first and second sub-pixels based on the first temperature deterioration data, and calculates the individual compensation gain of the third sub-pixel based on the second temperature deterioration data.

5. The organic light emitting display device according to claim 2, wherein the deterioration compensator further comprises:

a global compensation gain calculator configured to calculate a global compensation gain corresponding to all of the sub-pixels based on any one of maximum cumulative data, average cumulative data, and minimum cumulative data corresponding to the cumulative data of all of the sub-pixels; and a global compensator configured to modulate the input correction data of each of the sub-pixels according to the global compensation gain to generate input modulation data of each of the sub-pixels.

6. The organic light emitting display device according to claim 5, further comprising:

a data accumulator configured to generate the cumulative data of each of the sub-pixels by counting the input modulation data of each of the sub-pixels;

a first memory configured to store the cumulative data of each of the sub-pixels; and a second memory configured to store the accumulated first and second stress data.

7. A method for driving an organic light emitting display device, the organic light emitting display device comprising a plurality of unit pixels arranged in matrix form in a display area and each unit pixel comprising at least three sub-pixels corresponding to different colors and an organic light emitting diode corresponding to each of the sub-pixels, the method comprising:

generating deterioration estimation data of each of the sub-pixels based on cumulative data of each of the sub-pixels;

accumulating first stress data when display temperature data corresponding to a temperature of the organic light emitting display device is higher than or equal to a predetermined threshold temperature in a predetermined measurement cycle;

accumulating second stress data when the display temperature data is less than the predetermined threshold temperature in the predetermined measurement cycle;

generating first temperature deterioration data based on the accumulated first stress data;

generating second temperature deterioration data based on the accumulated second stress data;

calculating an individual compensation gain of each of the sub-pixels based on the deterioration estimation data of each of the sub-pixels and the first or second temperature deterioration data; and generating input correction data of each of the sub-pixels by correcting input data of each of the sub-pixels according to the individual compensation gain of each of the sub-pixels, wherein the first stress data corresponds to cumulative usage of a first organic light emitting layer at a temperature higher than or equal to the predetermined threshold temperature, and the second stress data corresponds to cumulative usage of a second organic light emitting layer at a temperature less than the predetermined threshold temperature.

8. The method for driving an organic light emitting display device according to claim 7, wherein the first organic light emitting layer corresponding to mixture light of red and green light, and the second organic light emitting layer corresponding to blue light.

9. The method for driving an organic light emitting display device according to claim 8, wherein each of the unit pixels comprises first, second, third, and fourth sub-pixels corresponding to red, green, blue, and white colors, respectively, wherein the individual compensation gain of the first sub-pixel is calculated based on the deterioration estimation data of the first sub-pixel and the first temperature deterioration data, wherein the individual compensation gain of the second sub-pixel is calculated based on the deterioration estimation data of the second sub-pixel and the first temperature deterioration data, and wherein the individual compensation gain of the third sub-pixel is calculated based on the deterioration estimation data of the third sub-pixel and the second temperature deterioration data.

10. The method for driving an organic light emitting display device according to claim 7, further comprising:

calculating a global compensation gain corresponding to all of the sub-pixels based on any one of maximum cumulative data, average cumulative data, and minimum cumulative data corresponding to the cumulative data of all of the sub-pixels; and generating input modulation data of each of the sub-pixels by modulating input correction data of each of the sub-pixels according to the global compensation gain.

11. The method for driving an organic light emitting display device according to claim 7, further comprising:

generating the cumulative data of each of the sub-pixels by counting the input modulation data of each of the sub-pixels.

12. An organic light emitting display device, comprising:

a display panel comprising a plurality of unit pixels arranged in matrix form in a display area, each unit pixel comprising at least three sub-pixels corresponding to different colors and an organic light emitting diode corresponding to each of the sub-pixels;

a deterioration compensator configured to generate deterioration estimation data of each of the sub-pixels based on cumulative data of each of the sub-pixels, generate first and second temperature deterioration data based on display temperature data corresponding to temperature of the organic light emitting diode display, calculate an individual compensation gain corresponding to each of the sub-pixels based on the deterioration estimation data and the first or second temperature deterioration data, and correct input data of each of the sub-pixels based on the individual compensation gain of each of the sub-pixels;

a gate driver configured to supply a scan signal to each of the sub-pixels;

a data driver configured to supply a data signal corresponding to an output value of the deterioration compensator to each of the sub-pixels; and a timing controller configured to control driving of each of the gate driver and the data driver, wherein the deterioration compensator comprises:

a deterioration estimation data generator configured to generate deterioration estimation data of each of the sub-pixels based on the cumulative data of each of the sub-pixels;

a temperature deterioration data generator configured to generate the first and second temperature deterioration data based on the display temperature data corresponding to the temperature of the organic light emitting display device;

an individual compensation gain calculator configured to calculate the individual compensation gain of each of the sub-pixels based on the deterioration estimation data and the first and second temperature deterioration data; and an individual compensator configured to correct the input data of each of the sub-pixels according to the individual compensation gain of each of the sub-pixels to generate input correction data of each of the sub-pixels, and wherein the deterioration compensator further comprises:

a global compensation gain calculator configured to calculate a global compensation gain corresponding to all of the sub-pixels based on any one of maximum cumulative data, average cumulative data, and minimum cumulative data corresponding to the cumulative data of all of the sub-pixels; and a global compensator configured to modulate the input correction data of each of the sub-pixels according to the global compensation gain to generate input modulation data of each of the sub-pixels.

* * * * *